US005412622A

United States Patent [19]

Pauer et al.

[11] Patent Number: 5,412,622

[45] Date of Patent: May 2, 1995

[54] APPARATUS FOR DISCRIMINATING SOUND SOURCES IN A WATER ENVIRONMENT

[75] Inventors: Lyle A. Pauer, Brecksville; Thomas E. McCannon, Macedonia; Joseph G. Gardner, Painesville, all of Ohio

[73] Assignee: Loral Corporation, New York, N.Y.

[21] Appl. No.: 243,037

[22] Filed: May 16, 1994

[51] Int. Cl.[6] ..... H04R 17/00

[52] U.S. Cl. ..... 367/154; 367/131; 367/136

[58] Field of Search ..... 367/135, 136, 153, 154, 367/165, 173, 188, 131

[56] References Cited

U.S. PATENT DOCUMENTS 2,432,625 12/1947 Klein ..... 367/129

4,637,490 1/1987 Oxner ..... 367/154

*Primary Examiner*—Daniel T. Pihulic

*Attorney, Agent, or Firm*—Lee A. Germain; Ray L. Weber

[57] ABSTRACT

This invention provides an apparatus including a plurality of omnidirectional hydrophone sensors in a particularly configured array comprised of ring members which are carried between a plurality of tensioned cables, the cables being tensioned by an anchor weight at the bottom end of the array and a capsule float at the top end, the configuration enabling simplified signal processing techniques to achieve sound source discrimination in both azimuth and elevation within an underwater environment.

23 Claims, 4 Drawing Sheets

APPARATUS FOR DISCRIMINATING SOUND SOURCES IN A WATER ENVIRONMENT

FIELD OF THE INVENTION

This invention pertains generally to devices which discriminate against sound sources in a water environment.

More particularly, this invention provides an apparatus including a hydrophone sensor array that is deployable into a water environment and which is configured in a manner to provide signals which discriminate against sound sources in directions perpendicular to the array axis, i.e., azimuthal discrimination.

Specifically, the invention provides an apparatus which includes a hydrophone sensor array comprised of at least one ring member carrying quadrature mounted hydrophone sensors wherein the array is maintained in both vertical and horizontal position by way of crossed cable pairs which are tensioned by a float at the top end and an anchor at the bottom end.

BACKGROUND OF THE INVENTION

In the art of sound detection, an underwater environment is an extremely difficult one in which to operate sophisticated electronic equipment. Many acoustic sensing devices include hydrophone sensors and any misalignment requires compensation using complex signal processing techniques. Many of these employ accelerometer or vane type hydrophones to compensate for misalignment but this results in flow-induced vibrations which create noise in the system. There is, therefore a need in the art for an acoustic sensing apparatus which is simple to fabricate, cost effective, versatile for application to various uses, and which eliminates the complicated signal processing now required for these type apparatus.

It is, therefore, in accordance with one aspect of the present invention an object to provide an acoustic sensing apparatus comprised of state-of-the-art materials but fabricated using conventional techniques and which, when deployed into a water environment, is configured in a manner which reduces hydrophone misalignment to an extent that complex signal processing is eliminated in obtaining sound source discrimination.

In accordance with another aspect of the invention it is an object to provide an apparatus including a hydrophone sensor array comprised of ring-mounted, quadrature-oriented sensors and a tensioned cable arrangement which maintains both vertical separation and horizontal position of the sensors such that simplified and conventional signal processing techniques may be employed for sound source discrimination in directions which are perpendicular to the sensor array axis, i.e., azimuthal discrimination.

According to still another aspect of the invention it is an object to provide an apparatus including a hydrophone sensor array in a configuration such that sound source discrimination in both azimuth and elevation may be achieved.

In accordance with another aspect of the invention it is an object to provide an apparatus which may be compactly stowed and deployed into the ocean via surface ship, aircraft, or any other of the known deployment techniques and which, upon being so deployed, will automatically and in a fail-proof manner be configured into the desired shape and orientation for effective operation.

According to another aspect of the invention it is an object to provide a sensing apparatus for use in an ocean environment which may be configured as a passive listening device or, alternatively, as a passive listening device with an active response threat.

SUMMARY OF THE INVENTION

The various objects and advantages of the present invention may be achieved in an apparatus comprised of a float means, an anchor means, and a sensor array, the sensor array comprising multiple ring members each carrying quadrature-mounted hydrophone sensors and cable means interconnecting the ring members in a manner to achieve both horizontal and vertical stability when tensioned by the difference in buoyancy between the anchor and float means, the apparatus also having signal processing means which receive and combine the hydrophone sensor signal outputs to form cardioid signal patterns which discriminate any sound source inputs in both azimuth and elevation with reference to a vertical axis of the sensor array.

BRIEF DESCRIPTION OF THE DRAWINGS

The features and advantages of the present invention will be better understood and appreciated from a consideration of the following detailed description when taken in conjunction with the accompanying drawings in the several figures in which like-parts and/or elements bear like reference numerals and in which.

DETAILED DESCRIPTION OF THE PREFERRED EMBODIMENTS

Figure 2:
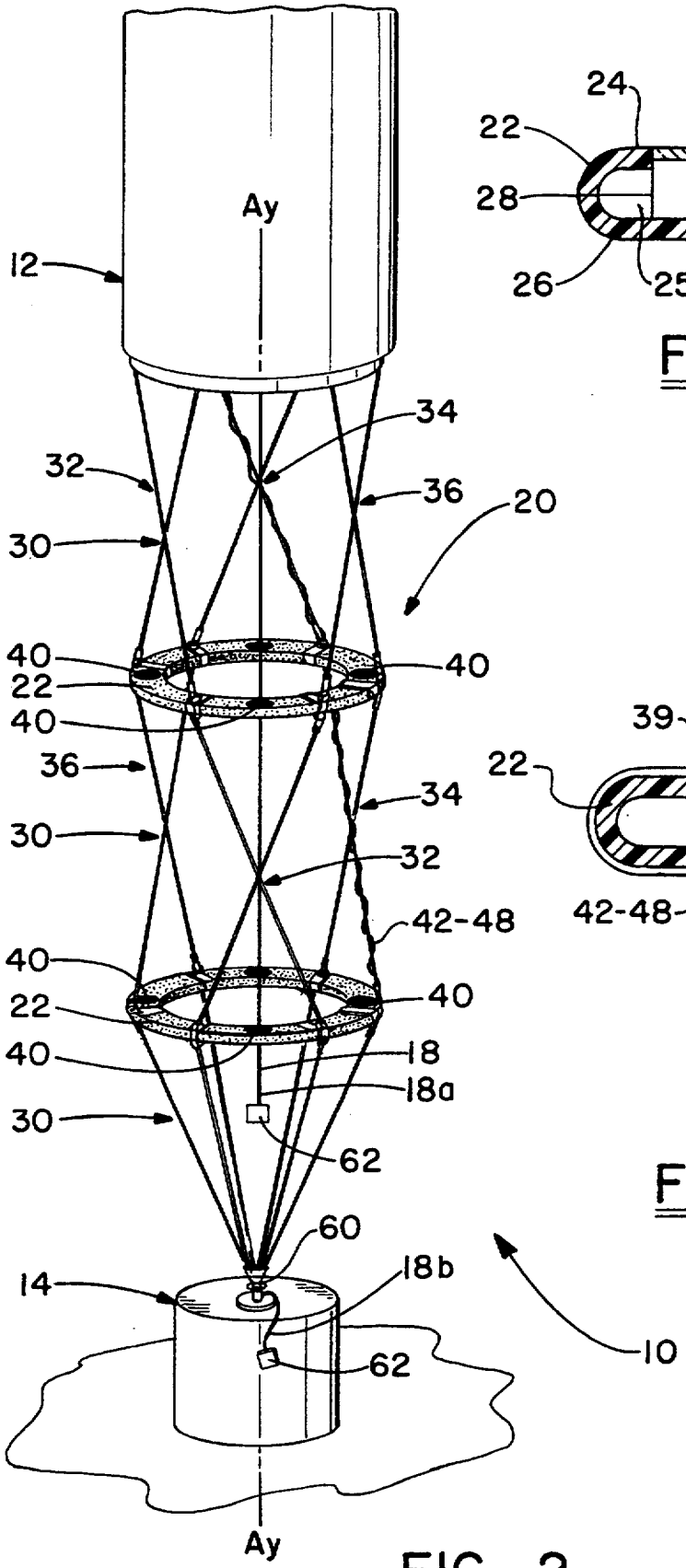
FIG. 2 is a perspective elevational view illustrating components which comprise the apparatus of the invention.

Referring firstly to FIG. 2 of the drawings, an apparatus in accordance with the invention is illustrated and generally indicated by reference numeral 10. The apparatus 10 comprises three functional components including (a) a capsule or float means 12, (b) an anchor or weight means 14, and (c) a sensor array generally indicated at reference numeral 20. The float means 12, weight means 14, and array 20 are all interconnected by way of a plurality of cable means 30 to provide a substantially stable vertically oriented structure. The cable means 30 function to maintain the sensor array 20 in both horizontal and vertical stable orientation within an underwater environment in a manner to be described hereinafter.

In its simplist form, the sensor arry 20 comprises at least one ring member 22 which is configured to carry at least one pair of omnidirectional hydrophone sensors 40 positioned at 180° with resepct to each other. It should be understood that, while FIG. 2 only shows a two ring member array 20, it is anticipated that any number of such rings 22 may be applied at the desires of the designer. The two ring array shown in FIG. 2 is for the purpose of illustrating the invention only and it does not limit the invention in any way. This will, of course, be made apparent as the description proceeds.

Each ring member 22 is preferably comprised of a material which exhibits a dimensional stability in all degrees of freedom and in salt water. A suitable material may be a reinforced plastic or other synthetic material and various ones are known to those persons knowledgeable and working in this art. Each of the ring members 22 may also exhibit an outside diameter dimension which can vary and this is determined by the operational frequency of the sensor array 20. While, of course, all of the ring members 22 of a particular array 20 will have the same diameter, the array diameter will be determined by the frequency. For example, a smaller diameter array will reflect a higher operational frequency while a larger diameter array will reflect a lower frequency and this is a well-known and understood phenomenon for these type systems. In this respect, it was found that a ring member 22 having an eighteen inch O.D. operated to satisfaction in the intended application. The invention, therefore, is not limited to a particular ring array diameter and/or operational frequency of the apparatus.

Figure 3:
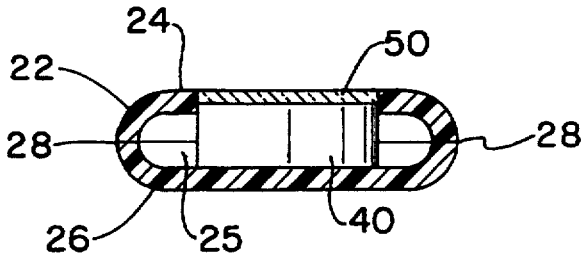
FIG. 3 is an elevational view, in cross-section, through a ring member which comprises a primary element of a sensor array, the section taken at a location of a hydrophone sensor.

Referring now also to FIG. 3 of the drawings, each ring member 22 may be made or fabricated in various ways using well-known techniques. For example, a ring may be comprised of a top element 24 affixed to a bottom element 26 at their mating interfaces 28. The elements 24,26 may define an annular bore 25 within which the hydrophone sensors 40 may be mounted. In a preferred configuration, each ring member 22 will carry four omnidirectional hydrophone sensors 40 in orthogonal pairs about the annular extent of the bore 25. The sensors 40 may be maintained in their respective positions by use of a suitable adhesive or potting material as well as by various types of fastening means. All of these are, of course, well-known to those knowledgeable and working in this art.

Further with reference to FIG. 3, each of the hydrophone sensors 40 is positioned with respect to an acoustically transparent window or membrane 50 which may be embedded in the material comprising the ring at each sensor location. The acoustic window 50 may be comprised of any suitable acoustically transparent material and various ones of these are known and conventionally used for this purpose in the art.

It will be recognized that the ring members 22 may be comprised of a solid material which is machined, molded, or otherwise formed to the ring configuration. Such solid construction may include pocket positions at the desired sensor locations into which the sensors 40 may be mounted. In the preferred embodiment of a hollow ring member 22, the sensors 40 and any other necessary electrical components and/or wiring may be carried within the confines of the annular bore 25 as shown in FIG. 3. It is anticipated that provisions for this may also be made using a solid section ring member and the invention, therefore, is not considered limited to a particular ring construction and/or cross-sectional configuration whether it be hollow or solid.

Figure 4:
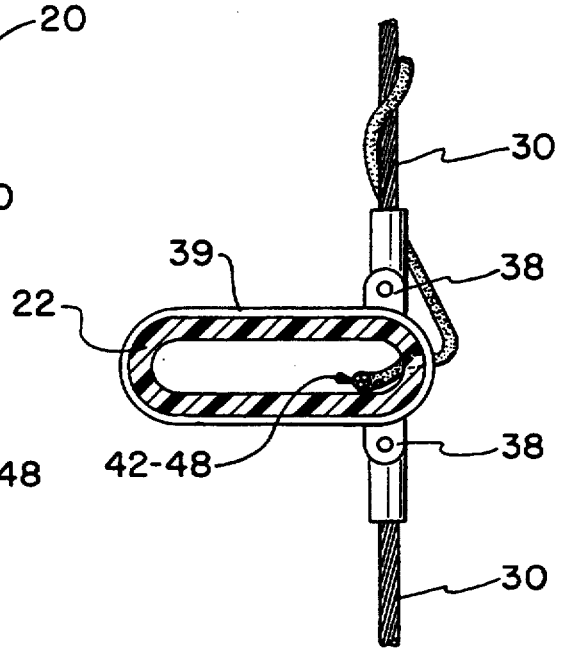
FIG. 4 is an elevational view, in cross-section, through a ring member at a location where cable means are mounted to the ring.

Referring to FIGS. 2 and 4 of the drawings, each ring member 22 of the sensor array 20 is connected to a ring member vertically adjacent to it via a plurality of cable means 30. There are three pairs of crossed-positioned cables 32, 34, and 36 and these are connected to a ring member at six positions about the peripheral extent of the ring. Thus, each cable is positioned 60° with respect to any adjacent cable on the ring. The crossed cables of a pair may or may not be oriented in any particular manner with respect to the cable pairs which are either above or below within the array 20. As shown in the figure, the top-most ring member 22 of the array is connected to the float means 12 via three pairs of crossed cables while the bottom-most ring member 22 is connected to the anchor 14 via six cables which are terminated at a swivel attachment 60.

In a deployed condition, the apparatus 10 is characterized by cable means 30 which are tensioned by the buoyancy of the float means 12. In this respect, the anchor 14 is at least two and one-half times the buoyancy of the float 12 while the ring members 22 are substantially neutrally buoyant. Accordingly, the cable means 30 are placed in tension when the apparatus 10 is deployed in salt water and, because of the crossed cable orientation, the ring members 22 are maintained in both vertical and horizontal position while the swivel means 60 allows everything above it to rotate if necessary about an Ay axis.

The cables 30 may be connected to the various components 12, 14, and 22 by way of various type swivel connectors 38 as illustrated in FIG. 4. The connectors 38 may be fastened to the ring member by any known fastening means and these may include a band 39 that is secured about the ring by way of any suitable adhesive or fastener. Obviously, there are many types of cable connectors which may be applied to this application and the invention is not considered limited to the particular one shown in the drawing. Further, the individual cables may be comprised of a stranded steel wire which is suitably coated for salt water application and these may be terminated at the ends for swivel action as shown. Alternatively, the cable means 30 may be comprised of any of the well-known systhetic materials such as, for example, a stranded Kevlar. In any configuration of the cable means 30, the material which comprises each cable should be dimensionally stable and should not stretch significantly when placed in tension. The length of the cable means may also vary and this is a function of the operational frequency of the sensor array 20. When the desired frequency of operation of the sensor array is known, the other parameters including the ring diameter and spacing and the cable length may be determined.

From the foregoing description it can be appreciated that a highly stable orientation of the hydrophone sensors 40 may be achieved. Accordingly, when a plurality of ring members 22 are positioned vertically and the quadrature-oriented sensors 40 of one ring member 22 are vertically aligned with respect to the quadrature-oriented sensors of any other ring member of the array 20, a three-dimensional scan of the water around the array Ay axis may be achieved in the area of influence of the array 20.

Figure 5:
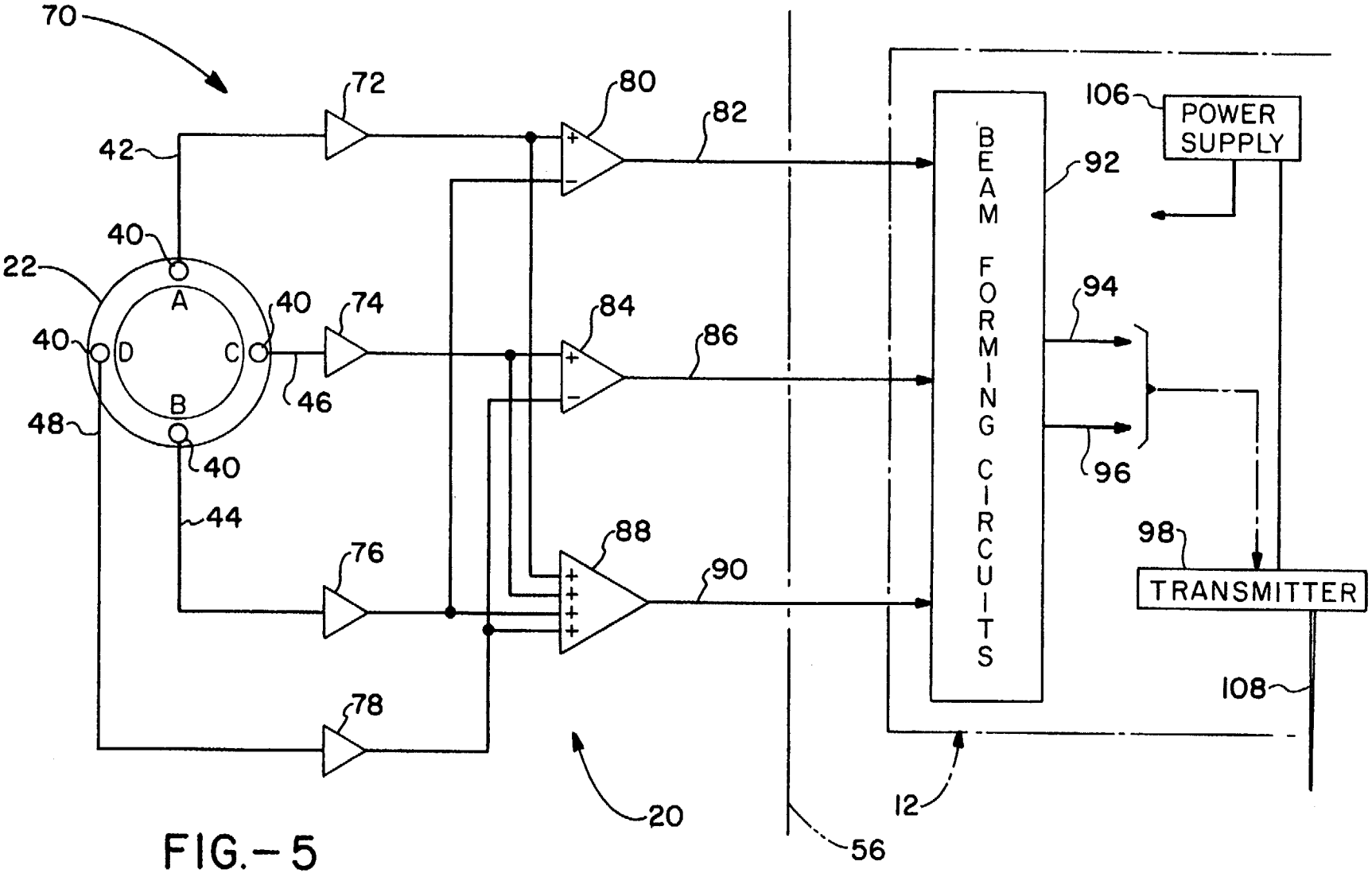
FIG. 5 is a schematic diagram illustrating the signal processing scheme which may be employed for acoustic signal discrimination.

Referring now to FIG. 5 of the drawings, the manner of signal processing to achieve directional discrimination is illustrated by the diagram generally indicated by reference numeral 70. The dot-dashed vertical line 56 in the figure indicates what elements may be associated with the sensor array 20 and what elements may be stowed away in the float means 12. A single ring member 22 is shown in the figure and it is characterized by four omnidirectional hydrophone sensors 40. Two sensors 40 forming a first pair are mounted in diametrically opposite positions as indicated at "A" and "B" in the figure while two sensors 40 forming a second pair are mounted in diametrically opposed positions and orthogonal to the first pair as indicated at "C" and "D" in the figure. Hydrophone sensor 40 at position "A" provides a signal output 42 that is fed to a preamplifier 72 while sensor 40 at the position "B" provides a signal output 44 that is fed to a preamplifier 76. Similarly, hydrophone sensor 40 at position "C" provides a signal output 46 that is fed to a preamplifier 74 while sensor 40 at the position "D" provides a signal output 48 to a preamplifier 78. The preamps 72 and 76 each provide an output signal to an amplifier 80 which subtracts to form an acoustic dipole signal 82. Similarly, the preamps 74 and 78 each provide an output signal to an amplifier 84 which subtracts to form an acoustic dipole signal 86. In addition, each of the preamps 72, 74, 76, and 78 provides an output signal to a summing amplifier 88 which adds to form an omnidirectional signal 90. The dipole signals 82 and 86 and the omnidirectional signal 90 are further combined in a beam former 92 to create a cardioid pattern. This is accomplished in a conventional manner using techniques that are well-known and understood by those working and knowledgeable in this art. The cardioid signals 94 and 96 from the beam former are finally fed to processing equipment (not shown) which provide discrimination in azimuth and in elevation of any sound sources that may have been picked up by the sensors 40. From this and a consideration of FIG. 2 it can be appreciated that, when the sensor array 20 includes a plurality of ring members 22, further discrimination in elevation may be achieved by the invention.

With reference again to FIG. 2, the apparatus 10 lends well to compact stowage of the components and to deployment in an ocean environment. The capsule float 12 is configured such that it may stow the plurality of ring members 22, their interconnecting cables 30, and the anchor weight 14 within its interior. Preferably, the capsule float 12 will be made from a suitable material such as, for example, a marine aluminum or similar type material which will operate in the salt water environment. The diameter of the capsule 12 will be such that an interior chamber is of sufficient diameter to accept the ring members 22 in axial orientation as well as the anchor weight 14. In this respect, the ring members may be carried around the anchor weight in a nested configuration. The float 12 will also have sufficient stowage within its interior for carrying any electrical equipment such as, for example, the beam forming circuitry 92 as indicated in FIG. 5. The bottom end of the capsule float 12 may have a closure means of a conventional type (not shown) or, the bottom end of the anchor means 14 may effect such a closure. How this is accomplished is conventional and not a limiting factor of the invention.

Also shown in FIG. 2 of the drawings is an axially positioned cable 18 which appears to interconnect the capsule float 12 with the anchor weight 14. In the stowed position of the apparatus 10, the cable portions **18*a* and 18*b* are connected together by way of a mechanism 62. The mechanism 62 is a force-activated device which is separated upon receiving a threshold force by deployment of the anchor 14. For example, the length of the cable 18 will be less than the deployed length of the sensor array 20 between the float 12 and the anchor 14 and when the weight of the anchor applies a force on the cable that exceeds a predetermined threshold, the mechanism 62 is activated separating the cable 18. This is done so that the full forces exerted by a separation of the anchor weight 14 from the capsule float 12 will not damage any elements of the sensor array 20**. Of course, other type mechanisms may be applied to accomplish this and the invention is not considered limited to any particular one.

Figure 1:
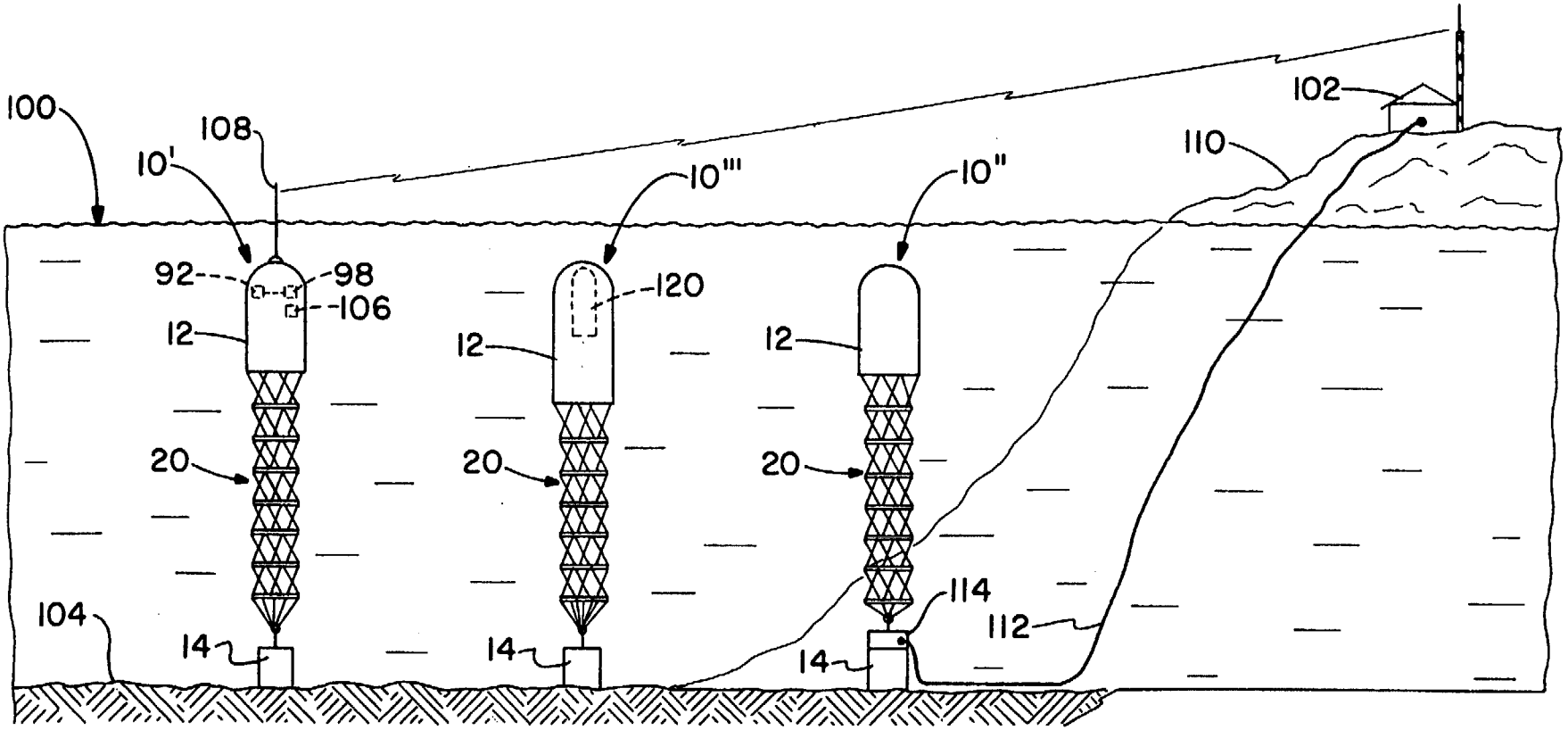
FIG. 1 pictorially illustrates the application of the invention as it may be deployed in at least three different modes of operation within an underwater environment.

Referring now to FIG. 1 of the drawings, the apparatus 10 is illustrated as it may be applied to various modes of operation within the ocean environment generally indicated at reference numeral 100. A first mode is indicated generally at reference numeral 10' wherein the apparatus is configured as a passive listening device which may be deployed from a surface ship or air-dropped into position via an aircraft. In any case, the apparatus 10' is deployed such that the anchor 14 exits the capsule float 12 in a manner to pull the sensor array 20 into its operational configuration. The cable 18 accepts the initial shock forces imposed upon deployment and the anchor 14 settles onto the ocean floor 104. A transmitter 98 may be housed within the capsule float 12 as well as a power supply 106 and it transmits the cardioid signal pattern outputs from the signal processing means 92 to a shore station 102 via an antenna 108 where signal processing equipment discriminates the sound sources which generated the signals in the hydrophone sensors of the sensor array 20.

A second mode of operation is indicated generally at reference numeral 10'' wherein the apparatus is also configured as a passive listening device. The apparatus 10'' is deployed in proximity to a landform 110 which may define a harbor area and it is positioned on the ocean floor 104 by way of various known methods. In this mode, the beam forming circuitry, power supply, and any other electrical equipment may be carried within a suitable canister 114 affixed to the anchor means 14 so as to be readily accessible to an underwater cable means 112 which transmits the cardioid pattern signal outputs to the shore station 102 where further signal processing and discrimination of sound sources may be carried on.

A third mode of operation is indicated generally at reference numeral 10''' wherein the apparatus is configured as a passive listening device coupled with an active threat response. In this mode, a small homing torpedo 120 of well-known and conventional design may be housed within the capsule float 12. Upon receipt of a proper signal from the sensor array 20, the torpedo may be launched to hunt down and kill the threat which generated the sound source signal. Again, the apparatus 10''' may be deployed into the water environment using surface and/or aircraft in the well-known manner. In this configuration, the difference in buoyancy as between the capsule float 12 and the anchor 14 may allow the apparatus to float, i.e., it will reach a buoyancy level at which it stays for operation.

Figure 6:
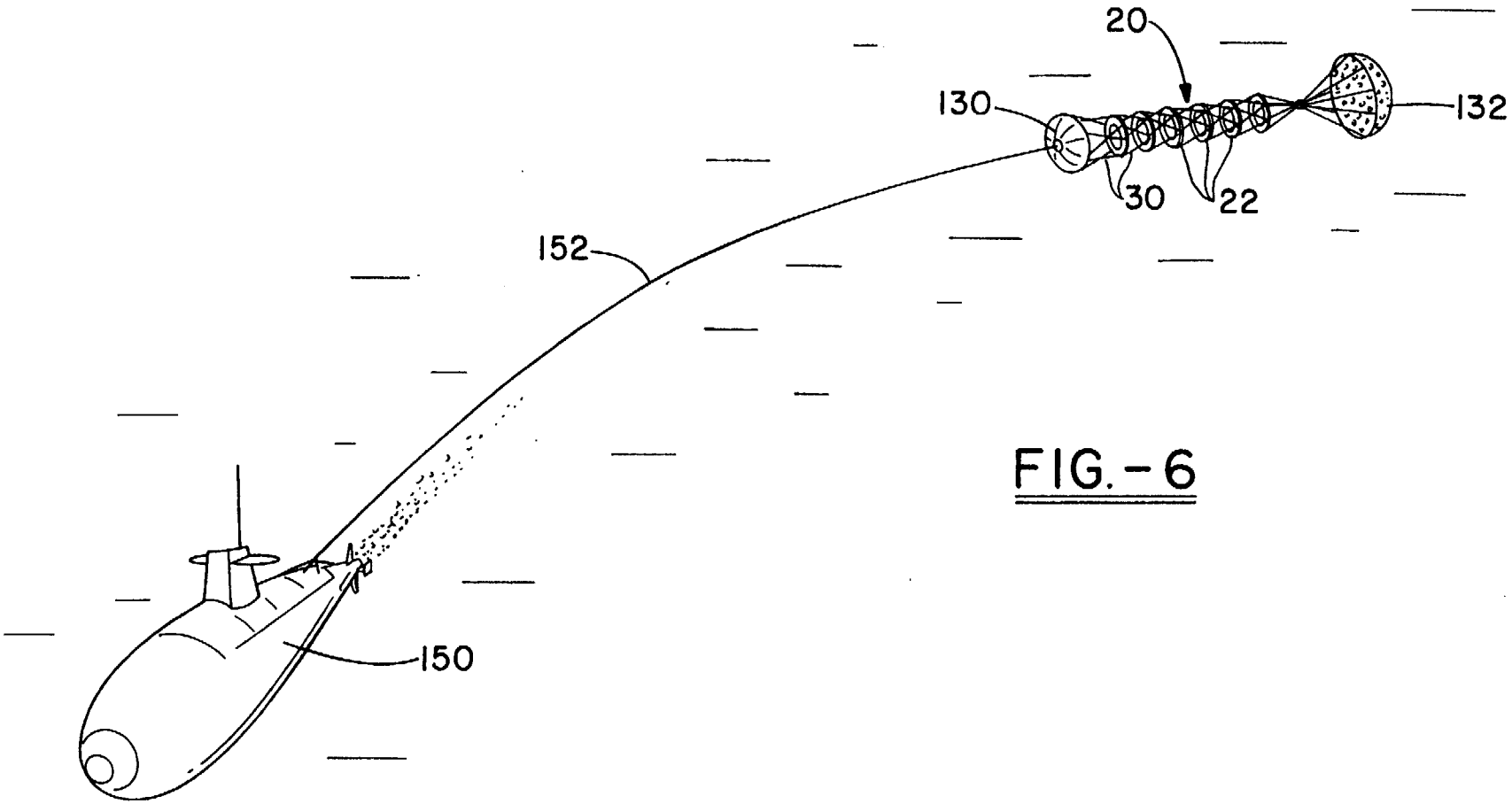
FIG. 6 pictorially illustrates an application of the invention wherein it may be towed in an underwater environment.

Referring now to FIG. 6 of the drawings, the invention is illustrated as it may be applied to a fourth mode of operation wherein the hydrophone array 20 is configured for being towed within the water environment by, for example, a submarine vehicle 150. In this configuration, the array 20 will be terminated at the top end by an aerodynamic shield 130 of any well-known configuration to protect the array from turbulance that may be generated by the towing vehicle which may affect the operation of the array. At the base end there will be a drogue member 132 which may comprise a sea anchor of well-known design which functions to effect tensioning of the cable means 30 interconnecting the hydrophone ring members 22. The various parameters of this towed configuration may be determined according to conventional techniques and these may include the particular length of the tow line 152 and the speed of the towing vehicle 150 to effect optimum performance of the array 20.

From the foregoing description and drawings it can be appreciated that the invention provides an acoustic sensing apparatus which effectively maintains hydrophone alignment such that complex signal processing may be eliminated and while various details have been shown for the purpose of illustrating the invention, it will be apparent to those skilled in the art that changes and/or modifications may be made therein without departing from the spirit or scope of the invention.

What is claimed is:

1. An apparatus for discriminating sound signal sources in an underwater environment comprises in combination:

(A) a float means;

(B) an anchor means;

(C) a sensor array comprising:

(a) at least one substantially circular ring member carrying a pair of omnidirectional hydrophone sensors each positioned 180° with respect to the other and providing output signals in response to acoustic input signals;

(b) cable means interconnecting the ring member with the float and anchor means comprised of crossed cables forming crossed-cable pairs, each of said cable means connected to the ring member at 60° spacing about the ring with respect to any adjacently connected cable means; and (D) signal processing means for receiving and combining the hydrophone sensor output signals to provide cardioid signal outputs;

said apparatus, upon deployment into an underwater environment, effecting tension forces on the cable means via the buoyancy of the float means which maintain the ring member in substantially confirmed vertical and horizontal attitudes such that the cardioid signal outputs provide discrimination in both azimuthal and elevational directions with respect to a vertical axis of the sensor array.

2. The apparatus as claimed in claim 1 wherein the sensor array comprises at least two ring members each of which carries pairs of quadrature-mounted omnidirectional hydrophone sensors and the rings are separated vertically and interconnected together via cable means.

3. The apparatus as claimed in claim 1 wherein the anchor means and the sensor array are stowable within the confines of the float means and upon deployment the anchor means draws out the sensor array for positioning in the underwater environment.

4. The apparatus as claimed in claim 1 wherein the ring member comprises a material exhibiting a dimensional stabliity in all degrees of freedom and in salt water.

5. The apparatus as claimed in claim 4 wherein the ring member is hollow and the hydrophone sensors are mounted within the interior hollow space of the ring member.

6. The apparatus as claimed in claim 4 wherein the ring member exhibits a solid cross-section.

7. The apparatus as claimed in claim 1 wherein a force separable cable is interconnected between the float and anchor means and it has a length less than the deployed vertical length of the sensor array such that it breaks upon receiving tension forces effected by deployment of the anchor means.

8. The apparatus as claimed in claim 2 wherein the signal processing means comprises:

a source of electrical power;

circuit means receiving output signals from a first pair of quadrature-mounted hydrophone sensors to provide a first dipole output signal;

circuit means receiving output signals from a second pair of quadrature-mounted hydrophone sensors to provide a second dipole output signal;

circuit means receiving output signals from each one of the quadrature-mounted hydrophone sensors to provide an omnidirectional output signal; and beam-forming circuit means receiving the first and second dipole output signals and the omnidirectional output signal to provide cardioid signal outputs which provide azimuthal and elevational information of sound signal sources within the water environment as received by the hydrophone sensors.

9. The apparatus as claimed in claim 8 wherein the signal processing means are stowed within the float means and these further comprise signal transmission means for transmitting the cardioid signal outputs of the beam-forming circuit means out of the underwater environment.

10. The apparatus as claimed in claim 8 wherein the signal processing means are stowed within a canister affixed to the anchor means and these further comprise signal transmission means for transmitting the cardioid signal outputs from out of the underwater environment.

11. An apparatus for deiscriminating sound signal sources in an ocean environment comprises in combination:

(A) a float means;

(B) an anchor means;

(C) a sensor array comprising:

(a) at least two substantially circular ring members each carrying at least two pairs of quadrature-mounted omnidirectional hydrophone sensors and each sensor provides an output signal in response to an acoustic input signal;

(b) cable means interconnecting the at least two ring members and from one ring member to the float means and from another ring member to the anchor means and the cable means comprises crossed-cable pairs wherein each cable is connected to a ring member at 60° spacing about the ring member with respect to an adjacently-connected cable means; and (D) signal processing means for receiving the hydrophone sensor output signals and combining the signals to provide cardioid pattern signal outputs;

said apparatus, upon deployment into the ocean environment, effects tensioning of the cable means which maintain the ring members in confirmed vertical and horizontal attitudes and the cardioid signals provide discrimination in both azimuthal and elevational directions with reference to an axis of the array.

12. The apparatus as claimed in claim 11 wherein the float means comprises a substantially cylindrically-shaped capsule adapted to house the anchor means and the sensor array in a stowed condition within the capsule.

13. The apparatus as claimed in claim 11 wherein the ring members are each comprised of a material exhibiting dimensional stability in all degrees of freedom and in salt water.

14. The apparatus as claimed in claim 13 wherein a ring member defines an annular bore within which the hydrophone sensors are mounted.

15. The apparatus as claimed in claim 14 wherein each of the hydrophone sensors is mounted in association with an acoustic membrane through which acoustic disturbances may be transmitted.

16. The apparatus as claimed in claim 13 wherein each ring member is comprised of a solid material.

17. The apparatus as claimed in claim 11 wherein a centrally located cable interconnects the float means to the anchor means and it has a length that is less than the overall length of the sensor array when it is deployed, said cable having a means which separates the cable into two parts in response to load forces imposed on it when the anchor means is deployed.

18. The apparatus as claimed in claim 11 wherein the signal processing means comprises:

a source of electrical power;

circuit means receiving output signals from a first pair of quadrature-mounted hydrophone sensors of each of the ring members to provide first dipole signal outputs;

circuit means receiving output signals from a second pair of quadrature-mounted hydrophone sensors of each of the ring members to provide second dipole signal outputs;

circuit means receiving output signals from each one of the hydrophone sensors of each of the ring members to provide omnidirectional signal outputs; and beam-forming circuit means receiving the first and second dipole signal outputs and the omnidirectional signal outputs to generate cardioid signal outputs which provide azimuthal and elevational information of any acoustic signal sources within the ocean influence vacinity of the apparatus.

19. The apparatus as claimed in claim 18 wherein the signal processing means are stowed within the float means and these further comprise signal transmission means for transmitting the cardioid signal outputs of the beam-forming circuit means out of the ocean environment.

20. The apparatus as claimed in claim 18 wherein the signal processing means are stowed within a canister affixed to the anchor means and these further comprise a signal transmission means for transmitting the cardioid signal outputs of the beam-forming circuit means out of the ocean environment.

21. The apparatus as claimed in claim 11 wherein the anchor means is connected to the sensor array cable means via a swivel connection.

22. The apparatus as claimed in claim 18 wherein the float means carries an active threat in the form of a homing torpedo which is launchable from the float means in response to a particular output signal from the signal processing means.

23. An apparatus adapted to being towed by a powered vehicle within an underwater environment for discriminating sound signal sources comprises in combination:

a sensor array comprising at least two substantially circular-shaped ring members each carrying pairs of quadrature-mounted omnidirectional hydrophone sensors providing output signals in response to an acoustic input;

cable means interconnecting the ring members to each other and to the float and anchor means comprising crossed-cable pairs and each cable of a pair is connected to a ring member at 60° spacing with respect to any adjacently-connected cable on the ring member;

means at the forward end of the sensor array to provide shielding of the array when it is towed within the underwater environment;

means at the rearward end of the sensor array to provide tensioning of the cable means when the array is being towed; and signal processing means for receiving and combining the hydrophone sensor output signals to provide cardioid signal outputs which are transmitted to the towing vehicle where signal source discrimination may be achieved.

* * * * *